US007730969B2

(12) United States Patent
Osadchuk et al.

(10) Patent No.: US 7,730,969 B2
(45) Date of Patent: Jun. 8, 2010

(54) REAMER AND METHODS FOR DIRECTIONAL DRILLING

(75) Inventors: Mark Osadchuk, Scottsdale, AZ (US); Steven L. Ugrich, Bovey, MN (US)

(73) Assignee: Southeast Directional Drilling, LLC, Casa Grande, AZ (US)

( * ) Notice: Subject to any disclaimer, the term of this patent is extended or adjusted under 35 U.S.C. 154(b) by 20 days.

(21) Appl. No.: 12/187,521

(22) Filed: Aug. 7, 2008

(65) Prior Publication Data

US 2009/0321140 A1 Dec. 31, 2009

Related U.S. Application Data

(60) Provisional application No. 61/076,298, filed on Jun. 27, 2008.

(51) Int. Cl.
*E21B 7/28* (2006.01)
*E21B 10/26* (2006.01)

(52) U.S. Cl. ..... 175/53; 175/344; 175/406

(58) Field of Classification Search ..... 175/53, 175/344, 345, 346

See application file for complete search history.

(56) References Cited

U.S. PATENT DOCUMENTS

| | | | |
|---|---|---|---|
| 5,224,540 | A | 7/1993 | Striech |
| 5,314,267 | A | 5/1994 | Osadchuk |
| 5,979,573 | A | 11/1999 | Osadchuk |
| 5,979,574 | A | 11/1999 | Osadchuk |
| 6,227,311 | B1 | 5/2001 | Osadchuk |

*Primary Examiner*—Hoang Dang
(74) *Attorney, Agent, or Firm*—Honigman Miller Schwartz and Cohn LLP

(57) ABSTRACT

A reamer for underground boring is provided. The reamer includes at least: (a) a center mandrel, wherein the center mandrel defines a mandrel axis; (b) a plurality of radial members extending radially from the center mandrel; (c) a plurality of cutting heads, wherein each of the cutting heads: (i) is supported by at least one of the radial members; (ii) is arcuately spaced-apart around the center mandrel from the other cutting heads; (iii) has a rounded surface; and (d) a plurality of cutting teeth on the rounded surface of each of the cutting heads. A method of horizontal drilling with the reamer is also provided.

17 Claims, 6 Drawing Sheets

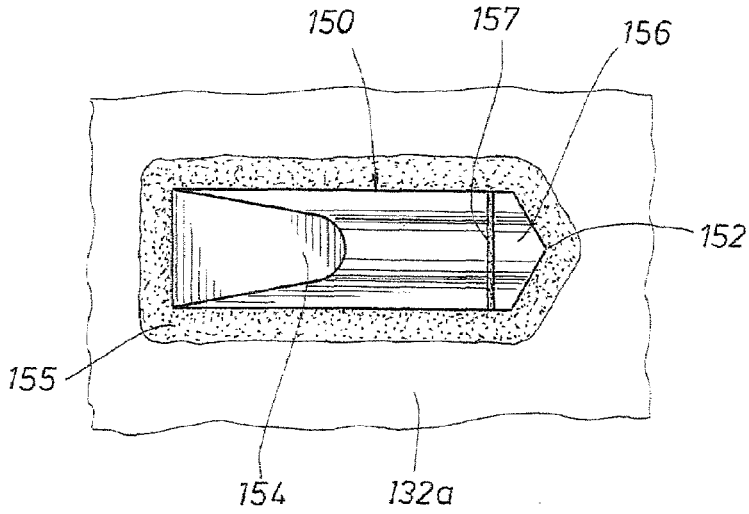
FIG. 8
FIG. 6
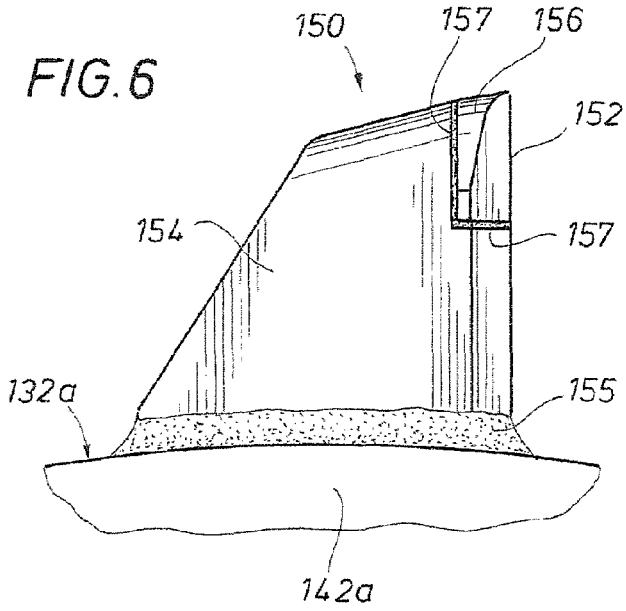
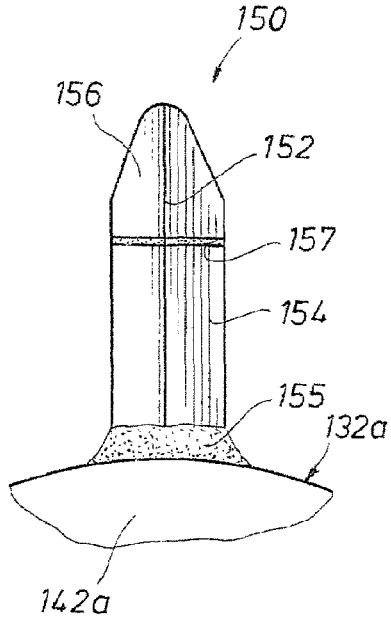
FIG. 7

REAMER AND METHODS FOR DIRECTIONAL DRILLING

CROSS-REFERENCE TO RELATED APPLICATIONS

This application claims priority to provisional patent application Ser. No. 61/076,298, filed Jun. 27, 2008 by applicant Mark Osadchuk.

STATEMENT REGARDING FEDERALLY SPONSORED RESEARCH OR DEVELOPMENT

Not applicable

REFERENCE TO MICROFICHE APPENDIX

Not applicable

BACKGROUND OF THE INVENTION

The present invention relates to the installation of underground pipelines, conduits, cables, and the like, and more particularly to installation using directional drilling, which is sometimes referred to as horizontal boring. More particularly, the invention relates to a reamer for use in enlarging a pilot bore in a method of horizontal drilling and a method of using the reamer in horizontal drilling.

U.S. Pat. No. 5,314,267 issued on May 24, 1994 to Mark Osadchuk, discloses a horizontal pipeline boring apparatus and method for installing a pipeline section under a surface barrier, such as a roadway or the like. According to that invention, a pilot bore is formed under the barrier. Next, a boring head, which is sometimes referred to in the art as a reamer or a hole opener, is used to enlarge the pilot bore. In addition, a guide is positioned on the advancing side of the boring head. The guide on the boring head is designed to engage the walls of the pilot bore and help steer the pipeline boring head during cutting along the path of the pilot bore. The pipeline section is advanced behind the boring head. Drilling liquids can be supplied to the boring operation through the pilot bore, and an auger in the pipeline section is used to help move drilling mud and cuttings away from the boring head through the pipeline section. U.S. Pat. No. 5,314,267 is hereby incorporated by reference in its entirety.

U.S. Pat. No. 5,979,573 issued Nov. 9, 1999 discloses a boring head for use in mounting to a drill pipe of a drilling rig for enlarging a pilot bore in horizontal boring operations. The boring head has an axial member positioned along a central axis of the boring head for connecting the boring head to the drill pipe of the drilling rig. A plurality of flanges extend radially from the axial member, and a flange support frame is provided for structurally interconnecting and supporting the flanges on the axial member. A plurality of cutting cones are mounted to the boring head. In particular, each of the cutting cones has a cone axis; each of the cutting cones is mounted to one of the flanges such that its cone axis extends at an acute angle ranging from zero degrees up to about 45 degrees relative to the central axis; each of the cutting cones is mounted for independent rotation about its cone axis; and each of the cutting cones has a plurality of independently-rotatable cutting bits mounted thereto. According to a further aspect of the invention, the cutting cones are arranged and positioned on the boring head to improve the cutting operation. U.S. Pat. No. 5,979,573 is hereby incorporated by reference in its entirety.

U.S. Pat. No. 5,979,574 issued Nov. 9, 1999 discloses a boring head provided for use in mounting to a drill pipe of a drilling rig for enlarging a pilot bore in horizontal boring operations. The boring head has an axial member positioned along a central axis of the boring head for connecting the boring head to the drill pipe of the drilling rig. A plurality of internally-tapered longitudinal pockets around the periphery of the axial member each receive an externally-tapered body mounting an independently-rotatable cutter bit which rotates about a rolling axis inclined at an angle in the range between ten degrees and eighty degrees with respect to the central axis of the boring head. The tapered body is drawn into the tapered pocket by a threaded retainer and forced into the pocket when boring by the force of the boring head against the bore face. U.S. Pat. No. 5,979,574 is hereby incorporated by reference in its entirety. (If there is any conflict between the usage or definition of a term in a patent incorporated by reference and the usage herein, the usage or definition herein will control.)

SUMMARY OF THE INVENTION

According to one form of the present invention, a reamer and a method for horizontal drilling are provided.

A reamer for underground boring is provided. The reamer includes at least: (a) a center mandrel, wherein the center mandrel defines a mandrel axis; (b) a plurality of radial members extending radially from the center mandrel; (c) a plurality of cutting heads, wherein each of the cutting heads: (i) is supported by at least one of the radial members; (ii) is arcuately spaced-apart around the center mandrel from the other cutting heads; (iii) has a rounded surface; and (d) a plurality of cutting teeth on the rounded surface of each of the cutting heads.

According to the method, a pit or trench is opened on each side of the barrier or area to be traversed underground. A pilot bore is formed between the two trenches. According to the invention, the reamer is used to enlarge the diameter of the pilot bore. Optionally, according to the invention, more than one size of a reamer may be used to stepwise increase the diameter of the pilot bore to a bore of a sufficient diameter for the pipeline section to be installed in the underground bore.

These and other features and advantages of the present invention will be more readily appreciated when considered in conjunction with the accompanying drawings.

BRIEF DESCRIPTION OF THE DRAWINGS

The accompanying drawings are incorporated into and form a part of the specification to illustrate several examples according to the presently most-preferred embodiments of the present invention. The drawings are only for illustrating preferred and alternative examples of the inventive methods and structures and are not to be construed as limiting the invention to only the illustrated and described examples. The drawings include the following figures:

FIG. 6 is a side view of an example of a cutting tooth of the reamer shown in FIGS. 3-5.

FIG. 7 is a front view of the cutting tooth shown in FIG. 6 looking toward the cutting edge of the cutting tooth.

FIG. 8 is a top view of the cutting tooth shown in FIG. 6 looking at the cutting tooth as it may be positioned on a portion of a rounded surface of a cutting head of the reamer shown in FIGS. 3-5.

DETAILED DESCRIPTION OF A PREFERRED EMBODIMENT

Figure 1:
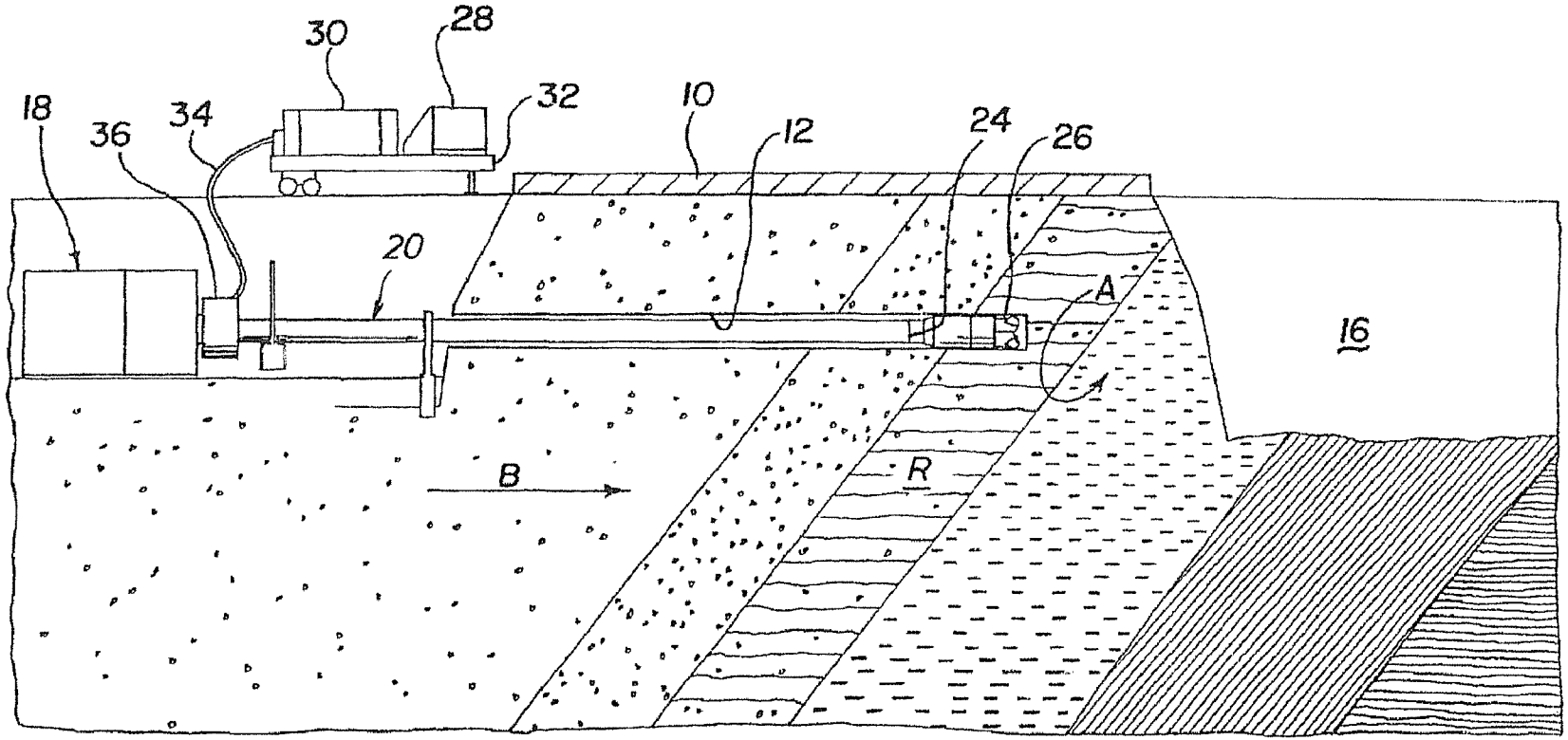
FIG. 1 is a schematic view illustrating an example of a step of drilling a pilot bore for installing a larger diameter section of pipe under a barrier, such as a roadway.

It can be highly desirable to install a pipeline under a barrier such as a highway, road, waterway, building, or other surface obstruction without disturbing the barrier. Typically, this has been done using a horizontal drilling method and apparatus to install the pipeline under the barrier.

In a process of installing a pipeline across a barrier such as a highway, for example, a pit or trench is opened on either side of the highway. A boring apparatus is placed on one side of the highway, and a passageway is bored under the highway between the two open trenches. The passageway, or bore, is of sufficient size to allow one or more sections of pipe to be pushed lengthwise through the bore from one side of the highway to the other. The installed section is then welded into the pipeline and tested.

More particularly, the typical process of directional drilling or horizontal boring includes several steps.

A pilot hole is the beginning of the directional drill crossing. The pilot hole is achieved either by excavation by fluid jetting or by a down-hole motor and drill. Depending on the condition of the soil, the pilot bore is formed along a predetermined alignment in which the path is selected by conventional methods. The typical pilot hole on most large rigs is 9⅞" but it can vary depending on the soil conditions and rig size. Drilling fluid is pumped through the drill pipe to the drill head at which time it is jetted through or pumped through a drill motor. The end of the drill pipe has a drill head to core the pilot hole. The drill fluid lubricates the drill stem and carries out the cutting to the surface. The drill fluid is then recycled and re-injected into the drill stem. The step of forming the pilot hole can take several days, depending on the condition of the soil and may require changing of the drill pipe or drill head.

Once the pilot hole has been completed, the second step is enlarging the pilot bore in a reaming process. The reaming process employs a reamer, which is sometimes referred to as a hole opener. Reamers come in different shapes and sizes and vary depending on the soil conditions and density of the soil; typically, a fly cutter is used in good ground conditions. The reaming pass is done in several steps depending on the size of the hole, (example: 42" diameter finish hole would be 3 to 5 different ream passes of 14", 20", 34", and 42" diameter). A reamer is attached to the drill string and is rotated and pushed or pulled while rotating, and drill fluid is pumped to the reamer through the drill pipe. The excavated soil is suspended in the drill fluid and then brought to the surface and recycled. When the reamer is attached to the drill string, there will always be a drill pipe on both sides of the reamer allowing for the drill string to be in the hole at all times. The reaming process can take a significant amount of time depending on the condition of the soil.

After the desired hole has been achieved and the reamer has passed through it completely, a mud pass, or packer reamer, will be done to assure that the hole is clean of all excavated material and that the drill fluid has filled the hole completely, to allow for a smooth lubricated pull back of the pipe, avoiding friction of the pull section.

The final step is pulling the pipe into the reamed hole. A weld cap is installed on the pipe where a swivel is placed attaching the drill string, thus, not allowing any rotation of the pipeline. Depending on the size of the pipe, an artificial buoyancy measure might be taken. This is to keep the pipeline close to neutral buoyancy. If no measures are taken, several problems may occur (example: coating damage from pipe floating in drill fluid and causing excess friction causing more pull). Most typically, buoyancy control is done with pumping water into the pipeline through P.V.C. pipe and checking the gallons pumped.

At completion of direction drill, demobilization and clean-up takes place.

When rock or other hard materials are encountered in the drilling operation, problems can arise which cause the installation to be difficult and expensive. For example, when installing a large-diameter pipeline such as a 36" or 40" pipeline under an interstate highway that may be 300 feet wide, massive forces can be present during the horizontal drilling process. This can be caused by the fact that, when hard materials are encountered by a large boring apparatus, it is difficult, if not impossible, to form the bore in a straight path. When rock or other hard materials are encountered, a reamer or hole opener can tend to corkscrew, bend, and deviate from a straight path. This causes installation of straight pipe to be difficult, if not impossible. In some cases, the pipe will become stuck during the process of insertion into the bore. In such a case, the stuck pipe must be cut off, the old bore filled up and abandoned, and a new bore formed in the attempt to install the section of pipeline under the barrier. These and other difficulties in boring through barriers of rock or other hard materials cause the horizontal drilling process to be difficult and expensive.

The need for improvements is particularly long-felt in horizontal drilling for installing large-diameter pipeline sections. The larger the diameter of the desired bore, the greater the twisting force that is created in the drilling operation. According to the laws of physics, torque is the product of the force and the perpendicular distance from the line of action of the force to the axis of rotation. The hardness of the rock, the advancing force on the boring head, and all else being equal, for any given radial distance from the axis of the boring operation, the resulting torque is a product of that radial distance. Thus, the larger the boring head, the greater the perpendicular distance from the line of action of the force to the axis of rotation. The torque is created at every point along the radial cutting swath of the boring operation, such that the integral summation of these torques increases the width of the cutting swath of the boring operation.

For example, in opening up a 9-inch pilot bore to 30 inches in a single drilling operation, the cutting swath is about radial 21 inches wide. Thus, a 30-inch diameter boring head working against hard rock in this 21-inch wide cutting swath toward the periphery of the boring head creates a substantial twisting force (torque) about the axis of the pilot bore. If attempting to open up a 9-inch pilot bore to 60 inches in a single drilling operation, the cutting swath would be about 51 inches wide, and the tremendously increased torques involved would usually make such a drilling operation impossible. Thus, it is usually not possible to enlarge the initial pilot bore to a very large diameter bore in a single drilling operation.

To install a 60-inch pipeline, for example, the relatively small pilot bore must usually be opened up to at least one intermediate diameter. If very hard rock is encountered, it may be necessary to use several stepwise drilling operations to open up the pilot bore to successively-larger-and-larger diameter bores until the desired diameter is achieved. For example, the pilot bore may be first enlarged to 24 inches, then, in a second drilling operation, be enlarged to about 42 inches, and finally in a third drilling operation, enlarged to 60 inches.

Despite enlarging the pilot bore in stepwise drilling operations, in opening up a 42-inch bore to 60 inches, for example, the 60-inch diameter boring head working against hard rock in the 18-inch cutting swath toward the periphery of the boring head creates tremendous twisting force about the axis of the pilot bore. Even if the guide in the pilot bore helps maintain the drilling operation in a substantially straight line, the tremendous twisting force causes the drilling operation to drill eccentrically of the central axis of the pilot bore. With each successive drilling operation to increase the bore size, the off-center drilling creates an increasingly misshapen bore, which tends to become increasingly triangular and can be loosely described as "A" shaped. This then requires that a substantially larger bore must be formed to install the desired large pipeline, which costs time and money.

Furthermore, the twisting forces created in the drilling operation can be so large that the boring head becomes increasingly likely to completely twist off its drive shaft, also referred to as a drill pipe. If the boring head twists off the drill pipe, retrieving the boring head can be very time consuming and expensive, and the boring operation may have to be abandoned in favor of a new attempt.

FIG. 1 illustrates the step of drilling a pilot bore 12 under a barrier 10, such as a roadway. A first trench 14 is opened on one side of the barrier 10. In addition, a second trench 16 is opened on the opposite side of the barrier 10 along the intended path for a pipeline (not shown). The first and second trenches 14 and 16 are dug to the appropriate depth for placement of a pipeline section under the barrier 10. It is to be understood, of course, the references to "first" and "second" trenches are arbitrary, as it is not critical which one is actually opened first or second.

Once the first and second trenches 14 and 16 are opened, the step of drilling the pilot bore 12 is accomplished by using a horizontal drilling rig 18, which can be of any conventional or appropriate design and of the necessary size and power. The drilling rig 18 has a powered rotator (not shown) for use in rotating a drill pipe 20 carrying a drill bit. The term "rotator" as used herein means any and all devices causing rotation of a drill pipe. Drilling rig 18 also is mounted on or includes an advancer for horizontally advancing the drilling operation. For example, the rig 18 can be mounted on tracks that allow the entire rig to move horizontally to advance the drilling operation. As used herein, the term "advancer" means any and all devices known in the art for causing the drilling or boring operation to be advanced in a horizontal direction.

Drilling the pilot bore 12 can be accomplished by rotating and horizontally advancing a drill pipe 20 with a drilling bit 26. The drill pipe 20 can be any suitable drive shaft for use in transferring rotational motion from the drilling rig 18 for use in the horizontal drilling operation. For example, as shown in FIG. 1, the drill pipe 20 has a threaded connector 24 at the forward end thereof. The drilling bit 26 is connected to the drill pipe 20 and is rotated and horizontally advanced by the drilling rig 18 during the step of drilling the pilot bore 12. Drilling bit 26 forms the desired pilot bore 12 from the first trench 14 to the second trench 16 beneath the barrier 10. It is to be understood, of course, that the step of drilling the pilot bore 12 can proceed in either direction from one side of the barrier 10 to the other.

During the step of drilling the pilot bore 12, the drill pipe 20 and drilling bit 26 are supplied with a drilling fluid, commonly referred to as drilling mud. The type of drilling fluid used is not critical to the practice of the invention. For example, drilling fluid pump 28 can be operatively connected to a drilling fluid tank 30. The pump 28 and tank 30 can be moved on a trailer 32. The pump 28 is operatively connected through a suitable flexible tubing 34 to a rotatable coupling 36 on the drill pipe 20. The drill pipe 20 has an axial passageway therethrough for the drilling fluid. Thus, pump 28 can pump drilling fluid from the tank 30, through flexible tubing 34, the rotatable coupling 36, and into the drill pipe 20. Drill pipe 20 spins within a sliding seal in the coupling 36 while drilling fluid is pumped into and through drill pipe 20 to drilling bit 26. One or more small ports (not shown) formed at the forward end of the drill pipe 20 or in the drilling bit 26 deliver the drilling fluid to the exterior of the drilling bit 26. The flowing drilling mud cools the drilling bit 26 and aids in lubricating the cutting of the earth and rock to form the pilot bore 12.

The diameter of the pilot bore 12 is normally relatively small compared to the diameter of the pipeline section that is to be installed under the barrier 10. For example, a typical pilot bore 12 can be 8¾ inches in diameter. The particular size of the pilot bore is not critical, but it is important that the drilling bit 26 be sized so that a sufficiently stiff drill pipe 20 can be utilized to cut through any rock, such as a rock strata R, encountered under the barrier 10 while maintaining a straight bore. The relatively small diameter of the drilling bit 26 results in relatively small twisting forces during the drilling operation such that it is easier to form a straight pilot bore 12 beneath the barrier 10.

The drill pipe 20 is coupled to the drilling rig 18 for rotation as shown by arrow A. However, the direction of rotation, whether clockwise or counterclockwise, is not critical to the drilling operation. When connected to the drill pipe 20, the drilling bit 26 is designed to rotate with the drill pipe 20. Of course, when using a threaded connection, the direction of rotation should not unscrew the connection.

The drill pipe 20 and drilling bit 26 can be selectively moved or advanced in the forward and reverse direction of arrow B during boring. During the step of drilling the pilot bore, the drilling bit 26 is carefully advanced horizontally in the direction of arrow B to advance from trench 14 toward trench 16. Upon reaching the second trench 16, the pilot bore 12 is completed, and the drilling bit 26 is removed from the drill pipe 20.

Figure 2:
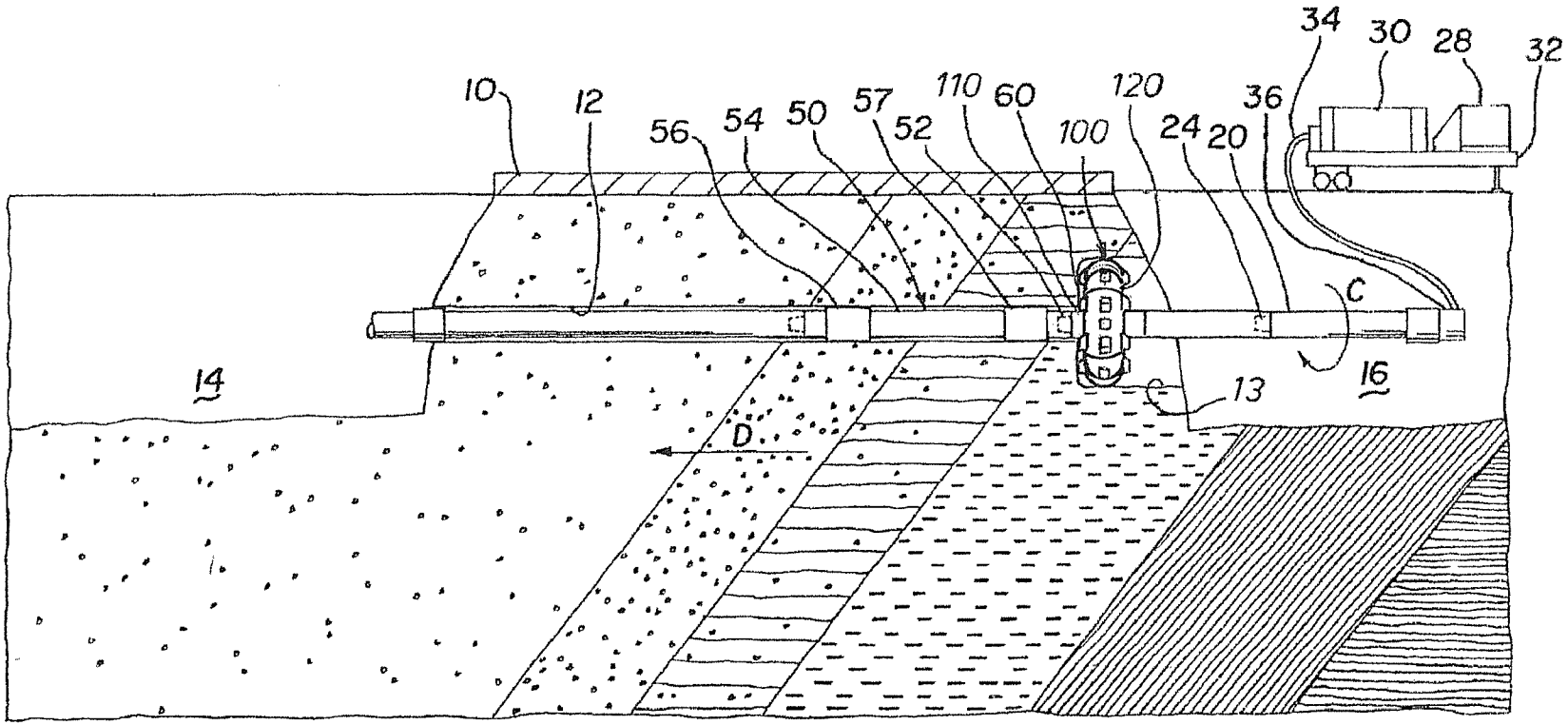
FIG. 2 is a schematic view illustrating an example of a step of enlarging a pilot bore according to one of the methods of the present invention for installing a larger diameter section of pipe under a barrier, such as a roadway.

FIG. 2 illustrates the step of enlarging the pilot bore 12 to an enlarged bore 13 having a larger diameter than the pilot bore 12. The drill pipe 20 is operatively connected to a drilling rig (not shown in FIG. 2) positioned in the second pipeline trench 16, similar to the situation previously described with respect to FIG. 1. Similarly, the drilling fluid pump 28, drilling fluid tank 30, and flexible tubing 34 are operatively connected to a rotatable coupling 36 as previously described with respect to FIG. 1. The reamer 100 is adapted to be coupled to a drill pipe 20 as generally illustrated in FIG. 2 and pushed or pulled by the rotating of the drill pipe 20 extending through a pilot bore to enlarge the size of the bore. According to an example of the invention, as will hereinafter be described in more detail, a reamer 100 is connected at the threaded male or pin connectors 24 and 52 to the drill pipe 20 extending through the pilot bore 12.

Presently most-preferred embodiments for the reamer 100 will hereinafter be described in detail. In general, however, as shown in FIG. 2, the reamer 100 has an axial mandrel 110, which is preferably similar in size to the drill pipe 20 and having a flow conduit therethrough for drilling fluid. The axial mandrel 110 also is used to connect the reamer 100 at the threaded connector 24 to the drill pipe 20. As will hereinafter be described in detail, the improved reamer 100 has a plurality of cutting heads 120 to cut through the rock and soil located below the barrier 10.

In addition, a guide assembly 50 can be connected in the string of drill pipe 20 at threaded connector 52 to the forward end of the axial mandrel 110 of reamer 100. In general, however, as shown in FIG. 2, the guide assembly 50 preferably includes a tubular member 54 with a cylindrical wear plate 56 and cylindrical guide 57 mounted thereon. As shown in FIG. 2, the cylindrical guide 57 is positioned in advance of the reamer 100 and is selected to be of a size to fit in and be guided by the walls of pilot bore 12. Guide 57 preferably also acts as a dam or seal on the walls of the pilot bore 12 to prevent the drilling fluid supplied to the reamer 100 from flowing forward through the pilot bore 12. In the illustrated embodiment, the guide 50 is positioned axially to the front or advancing side of reamer 100 a sufficient distance so that the straight guiding forces will apply sufficient torque to the reamer in the proper orientation. In the illustrated embodiment, the guide is positioned to the front of the head a distance of at least about the diameter of the pipeline section.

Enlarging the pilot bore 12 to the enlarged bore 13 can be accomplished by rotating and horizontally advancing the drill pipe 20 with the reamer 100 connected thereto. Reamer 100 enlarges the pilot bore 12 from the second trench 16 to the first trench 14 beneath the barrier 10. As the reamer 100 is advanced, the guide assembly 50 steers the reamer 100 along the path of the pilot bore 12. It is to be understood, of course, that the step of enlarging the pilot bore 12 can proceed in either direction from one side of the barrier 10 to the other. Further, the reamer 100 is attached at both ends to a drill pipe 20 extending between the first and second trenches, thus, using a drilling rig from either side is possible, and the reamer 100 can be pushed or pulled through the pilot bore 12.

During the drilling operation, the drill pipe 20 and reamer 100 are supplied with a drilling fluid. The type of drilling fluid used is not critical to the practice of the invention. As previously described, pump 28 pumps drilling fluid from the tank 30, through flexible tubing 34, the rotatable coupling 36, and into the drill pipe 20. One or more small ports that are preferably formed in the reamer 100 deliver the drilling fluid to the region of the cutting. The flowing drilling mud cools the cutting heads of the reamer 100 and aids in lubricating the cutting of the earth and rock to enlarge the pilot bore 12 to the desired enlarged bore 13. According to another embodiment, during a reaming pass, the pilot bore can be used to supply fluids to the reamer while the bore behind the reamer is utilized to remove the cuttings. As the enlarged bore 13 is being drilled, it remains substantially filled with drilling fluid and cuttings.

The drill pipe 20 is coupled to a drilling rig for rotation as shown by arrow C. However, the direction of rotation, whether clockwise or counterclockwise, is not critical to the drilling operation. Of course, when using a threaded connection, the direction of rotation should not unscrew the connection. When connected to the drill pipe 20, the reamer 100 is designed to rotate with the drill pipe 20 and enlarge the pilot bore 12.

The drill pipe 20 and reamer 100 can be selectively moved or advanced in the forward and reverse direction of arrow D during boring. During the drilling operation, the reamer 100 is carefully advanced horizontally in the direction of arrow D to advance from the second trench 16 toward the first trench 14.

Upon reaching the first trench 14, the enlarged bore 13 is completed, and the reamer 100 is removed from the drill pipe 20. It is to be understood, of course, that the step of enlarging the pilot bore 12 to the larger-diameter enlarged bore 13 can proceed in either direction from one side of the barrier 10 to the other.

As previously mentioned, more than one reaming pass may be used to enlarge the pilot bore 12 to the desired diameter for the enlarged bore 13. It should be understood, of course, that a reaming pass can be made from either the first trench to the second trench or the second trench to the first.

After reaming to obtain an enlarged bore 13 from one side of the barrier 10 to the other, the bore 13 remains substantially filled with drilling fluid and cuttings. A pipeline section is floated into the enlarged bore 13. Once the one or more pipeline sections are in position to span the barrier 10, the drilling mud is pumped out of the section(s), and the pipeline section can be tested for integrity against leaks.

It should also be understood that, under a wide barrier, such as a wide river, it is possible to install the pipeline along a gently curved path under the barrier.

Figure 3:
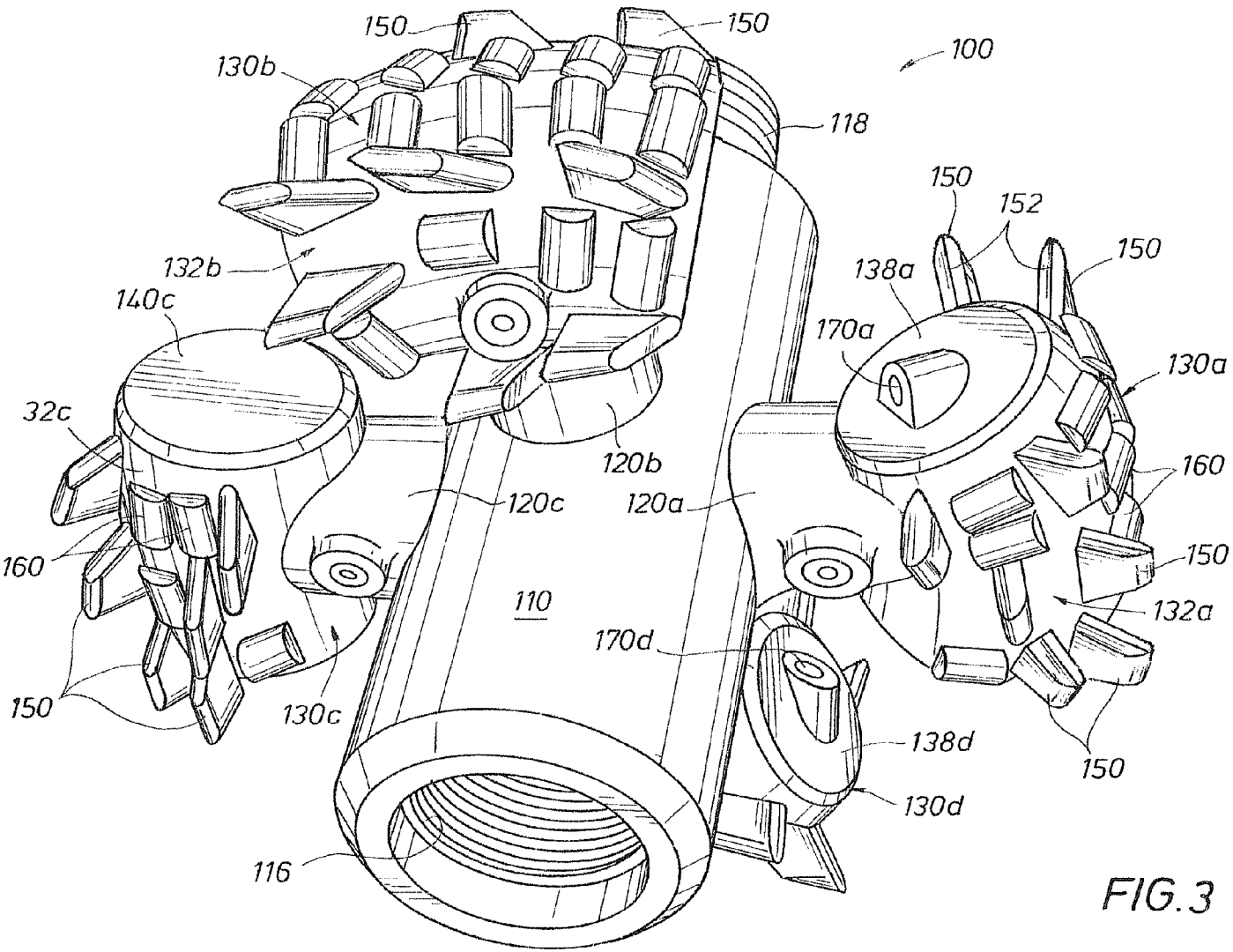
FIG. 3 is a perspective view of an example of a reamer according to the invention.
Figure 4:
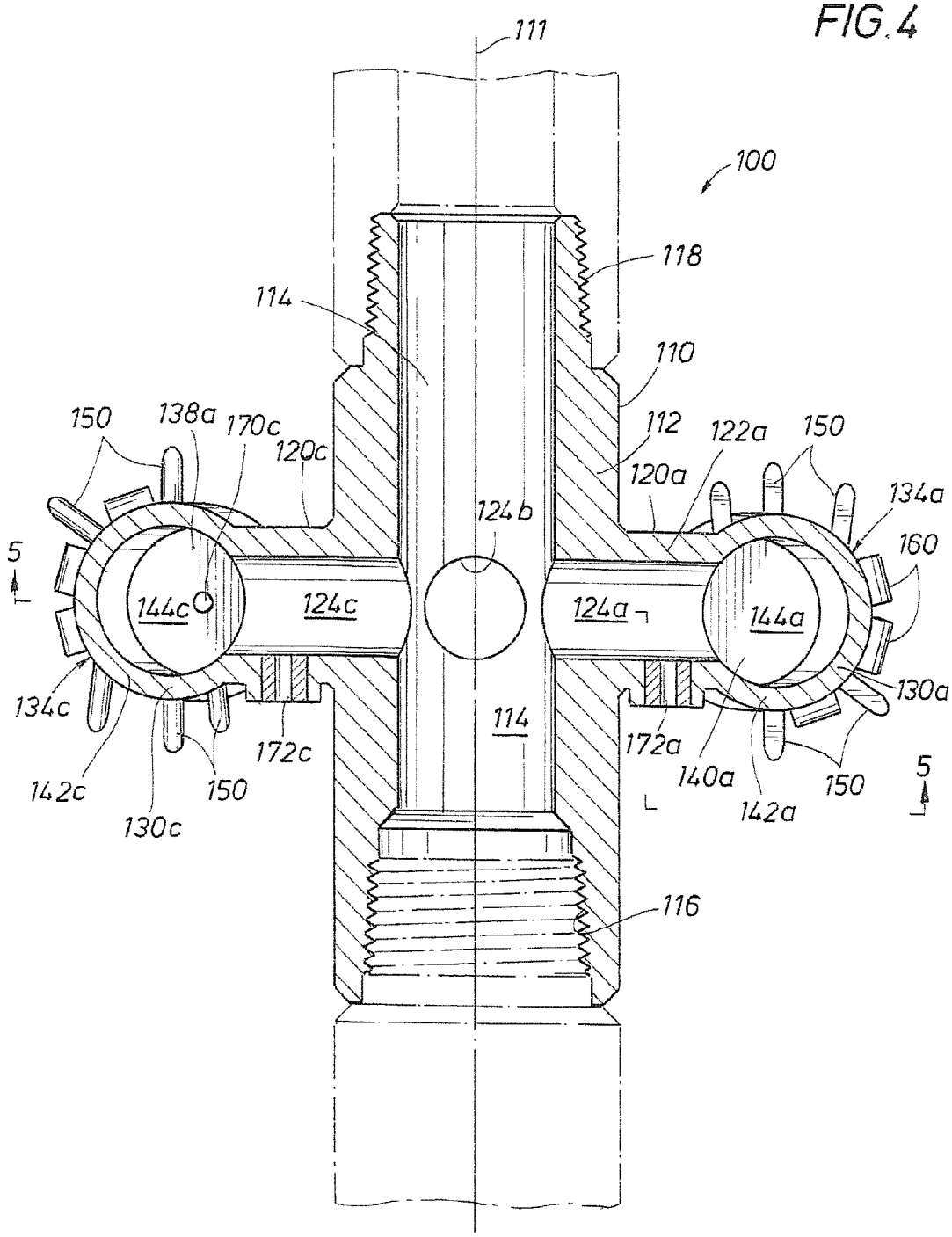
FIG. 4 is a cross-sectional view taken through a plane containing the mandrel axis and the center of two opposed radial members and cutting heads of the reamer shown in FIG. 3.
Figure 5:
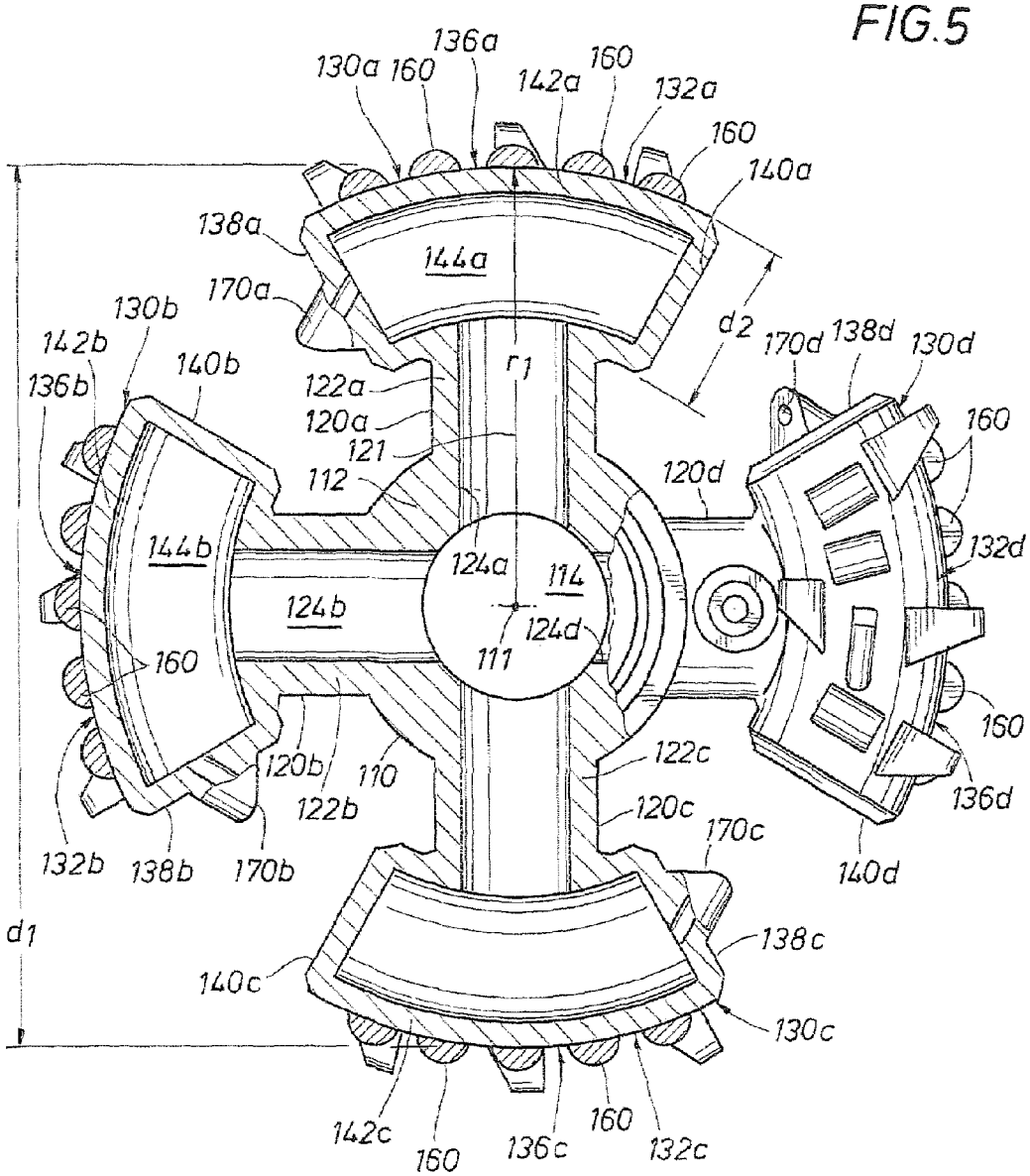
FIG. 5 is a partial cross-sectional view taken along lines 5-5 of view of the reamer shown in FIG. 4.

The details of an example of a reamer 100 according to the invention will be described by reference to FIGS. 3-8. Referring generally to FIGS. 3-5, the reamer 100 includes at least: (a) a center mandrel 110, wherein the center mandrel defines a mandrel axis 111 (as shown in FIGS. 4-5); (b) a plurality of radial members, for example radial members 120*a-d* extending radially from the center mandrel 110; (c) a plurality of cutting heads, for example, cutting heads 130*a-d*, wherein each of the cutting heads 130*a-d*: (i) is supported by at least one of the radial members 120*a-d*; (ii) is arcuately spaced-apart around the center mandrel 110 from the other cutting heads; (iii) has a rounded surface 132*a-d*, respectively; and (d) a plurality of cutting teeth 150 on the rounded surface 132*a-d* of each of the cutting heads, 130*a-d*, respectively.

As used herein, it should be understood that a "plurality" means at least two. Except as may otherwise be specified, of course, it should also be understood that an article comprising a "plurality" of an element with certain characteristics does not preclude having additional such elements with different characteristics or features. For example, in a reamer comprising a plurality of cutting teeth that has cutting edges oriented in a certain direction does not preclude the reamer additionally including other cutting teeth with cutting edges oriented in a different manner.

Referring now primarily to FIGS. 4-5, the center mandrel 110 defines a mandrel axis 111. The center mandrel preferably has a tubular body 112 defining a central passageway 114. A female threaded connector 116 is formed at one axial end of the center mandrel 110, and a male threaded connector 118 is formed at the other axial end.

A plurality of radial members, such as the radial members 120*a-d*, are disposed around the center mandrel 110. The radial members extend outward from the center mandrel along radial lines 121*a-d*, respectively, extending in a plane perpendicular to the mandrel axis 111. According to the example, each of the radial members has a tubular body 122*a-d*, respectively, defining a radial passageway 124*a-d*, respectively.

Cutting heads 130*a-d* are supported by the radial members 120*a-d*, respectively. Each cutting head 130*a-d* has a rounded surface 132*a-d*, respectively, wherein a portion of the rounded surface faces radially outward to present a curved profile when viewed from a direction along the mandrel axis.

Preferably, the curved profile of the rounded surface of each cutting head is of an arc of a circle having a radius from the mandrel axis. This arc is defined by a radius of the circle that is equal to or less than the radius of the bore the reamer is adapted to open, for example, equal to or less than the radius of a 24", 30", 36", 42", 48"-diameter bore, as the case may be. For example, each of the rounded surfaces 132*a-d* preferably has a curved profile 134*a-d*, respectively, in a plane including the mandrel axis, as best illustrated in FIG. 4, and each of the rounded surfaces 132*a-d* preferably has a curved profiled 136*a-d*, respectively, in a plane perpendicular to the mandrel axis, as best illustrated in FIG. 5.

In addition, each of the cutting heads 130*a-d* preferably has a forward rotational end 138*a-d*, respectively, which is facing toward the direction the reamer 100 is adapted to be rotated about the mandrel axis 111 when used in a reaming pass. Each of the cutting heads 130*a-d* preferably also has a rearward rotational end 140*a-d*, which is facing in the opposite direction the reamer 100 is adapted to be rotated about the mandrel axis 111 when used in a reaming pass.

Most preferably, each cutting head 130*a-d* has a body in the shape of a fractional segment of a torus. In geometry, a torus (pl. tori) is a surface of revolution generated by revolving a circle in three-dimensional space about an axis coplanar with the circle, which does not touch the circle. A torus has a major radius, that is, the radius of revolution about the axis that is coplanar with the circle, and it has a minor radius, that is, the radius of the circle. Unless otherwise specified, as used herein, the major radius of a torus is the length from the axis to the outermost edge of the circle from the axis of the torus. Another expression of the definition is that a torus is a surface obtained by rotating a circle about a line that lies in its plane, but which has no points in common. Examples of tori include the surfaces of doughnuts and inner tubes. (A solid contained by the surface is known as a toroid.)

For example, in the illustrated reamer 100, which has four cutting heads 130*a-d*, each of the cutting heads 130*a-d* has a one-eighth torus-shaped body 142*a-d*, respectively. In the illustrated embodiment, the one-eighth torus-shaped body 142*a-d* defines a head passageway 144*a-d*, respectively. It should be understood, of course, that, if the reamer has three cutting heads, for example, each would preferably be a one-sixth torus-shaped body, or more cutting heads, for example, five cutting heads, each would preferably be a one-tenth torus-shaped body. The mandrel axis is also the torus axis, and the torus has a major radius measured from the mandrel axis 111. The torus shape defines a major radius $r_1$ (not shown) and a minor radius $r_2$ (shown in FIG. 5), each of which is one-half the diameter d1 and d2, respectively, both of which are shown in FIG. 5. It should be understood that the shape does not have to be part of a perfect torus, although it can be. Preferably, the mandrel 110, the radial members 120*a-d*, and cutting heads 130*a-d* are rotationally balanced around the mandrel axis 111.

Preferably, the minor radius of the torus is less than the difference of the major radius of the torus and the outer radius of the center mandrel. Preferably, the torus has a minor radius that is in the range of ½ to 1 times that of the outer radius of the center mandrel.

Each of the curved surfaces 132*a-d* of the cutting heads 130*a-d*, respectively, preferably includes a plurality of cutting teeth. The cutting teeth can be in the form of cutting spikes, wedges, or blades. Preferably, the cutting teeth are in the form of the cutting teeth 150, as shown in the FIGS. 3-8 of the drawing. Each of the cutting teeth 150 has at least one cutting edge, such as cutting edge 152 illustrated in the figures. The cutting teeth 150 on each of the curved surfaces 132*a-d* assist in cutting swaths of rock and soil as the reamer 100 is rotated in a rotational direction about mandrel axis 111. Each of the plurality of cutting teeth on the rounded surface 132*a-d* of each of the cutting heads 130*a-d* has at least one cutting edge 152, wherein at least a portion of a length of the cutting edge 152 is oriented facing a direction of rotation of the reamer 100 around the mandrel axis 111. Each of the cutting teeth 150 is preferably formed of tungsten carbide.

Referring now primarily to FIGS. 6-8, a representative cutting tooth is shown in detail. Each cutting tooth 150 has a tooth body 154, which is welded at weld 155 to a rounded surface 132*a-d* of a cutting head 130*a-d*, respectively. The cutting edge 152 is preferably part of a replaceable section 156. The replaceable section 156 is welded to the tooth body 154 at weld 157. Of course, the entire cutting tooth 150 can be replaced, if needed.

Referring back to FIGS. 3-5, each of the curved surfaces 132*a-d* of the cutting heads 130*a-d*, respectively, preferably has a plurality of wear bars 160 thereon. Each of the wear bars 160 preferably has the form of a semi-cylindrical body. Each of the wear bars 160 is welded on the flat side thereof to one of the surfaces 130*a-d*. Each of the wear bars 160 is preferably formed of tungsten carbide. The wear bars 160 assist in grinding rock and soil and preserving the curved surfaces 132*a-d* as the reamer 100 is rotated about mandrel axis 111.

The cutting teeth 150 and wear bars 160 on the rounded surfaces 132*a-d* of the cutting heads 130*a-d*, respectively, cut and grind dirt and rock to increase the diameter of the pilot bore or to further increase the diameter of a previously-enlarged bore.

Preferably, the reamer 100 has a plurality of mud ports for drilling fluid that are included for allowing drilling fluid to be pumped to the region of the reamer to lubricate the drilling operation. For example, each of the cutting heads 130*a-d* preferably has a mud port 170*a-d*, respectively, positioned on the forward rotational end 138*a-d*, respectively, as best shown in FIG. 5. Further, for example, mud ports 172*a* and 172*c* can be positioned on radial members 120*a* and 120*c*, respectively, as best shown in FIG. 4. The particular arrangement and shape of the mud ports can be varied, although the illustrated example is preferred. The mud ports 170*a-d* and 172*a* and 172*d* communicate with passageways 114, 124, and 144.

As illustrated in FIGS. 3-5, the cutting teeth 150 are positioned around the periphery of the curved surfaces 132*a-d* of the cutting heads 130*a-d*, respectively. The separate cutting teeth are spaced apart and staggered across the curved surfaces, preferably both axially relative to the mandrel axis arcuately around the reamer 100. The number and particular arrangement of the cutting teeth 150 and wear bars 160 can be varied. More or less cutting teeth could be used as required for a particular application. Preferably, the number and arrangement of the cutting teeth 150 provide staggered cutting swaths across the entirety of all the paths of all the curved surfaces 132*a-d* of the cutting heads.

The radial members 120 should be sufficiently strong to withstand the forces encountered during horizontal boring and allowing arcuate spacing around the mandrel axis between the cutting heads 130*a-d*. Preferably, for example, each of the radial members 120*a-d* has a tubular body 122*a-d*, respectively, that has an outer diameter approximately one-half the outer diameter of the mandrel 110, and each of the tubular body 122*a-d* of the radial members 120*a-d*, respectively, is of similar thickness to the tubular body 112 of the mandrel 110.

Preferably, the major radius of the circle of the one-eighth torus-shaped body 142*a-d* of each of the cutting heads 130*a-d*, respectively, is approximately equal to the outer diameter of the center mandrel.

A reamer according to the invention has an advantage of not requiring any moving parts as it is rotated in the difficult environment of underground boring.

As used herein, the words "comprise," "has," and "include" and all grammatical variations thereof are each intended to have an open, non-limiting meaning that does not exclude additional elements or steps. It is to be understood that numerous modifications, alterations, and changes can be made in the invention without departing from the spirit and scope of the invention as set forth in the appended claims. It is my intention to cover all embodiments and forms of my invention within the allowable scope of the claims.

What is claimed is:

1. A reamer for underground boring, the reamer comprising:

(a) a center mandrel, wherein the center mandrel defines a mandrel axis;

(b) a plurality of radial members extending radially from the center mandrel;

(c) a plurality of cutting heads, wherein each of the cutting heads:

(i) is supported by at least one of the radial members;

(ii) is arcuately spaced apart around the center mandrel from the other cutting heads;

(iii) has a rounded surface, wherein the rounded surface is of an arcuate section of a torus; and (d) a plurality of cutting teeth on the rounded surface of each of the cutting heads.

2. The reamer according to claim 1, wherein the center mandrel has two axial ends and further comprising a first connector at one axial end thereof for connecting the center mandrel to a drill pipe.

3. The reamer according to claim 2, wherein the center mandrel further comprises a second connector on the other axial end thereof for connecting the center mandrel to the drill pipe.

4. The reamer according to claim 3, wherein each of the first and second connectors comprises a threaded connector.

5. The reamer according to claim 1, wherein a portion of the rounded surface faces radially outward to present a curved profile when viewed from a direction along the mandrel axis.

6. The reamer according to claim 5, wherein the curved profile of the rounded surface of each cutting head is of an arc of a circle having a radius from the mandrel axis.

7. The reamer according to claim 1 wherein the mandrel axis is also the torus axis, and the torus has a major radius measured from the mandrel axis.

8. The reamer according to claim 1 wherein the minor radius of the torus is less than the difference of the major radius of the torus, and the outer radius of the center mandrel.

9. The reamer according to claim 1, wherein the torus has a minor radius that is in the range of ½ to 1 times that of the outer radius of the center mandrel.

10. The reamer according to claim 6, wherein the radial members and cutting heads are rotationally balanced around the mandrel axis.

11. A reamer for underground boring, the reamer comprising:

(a) a center mandrel, wherein the center mandrel defines a mandrel axis (b) a plurality of radial members extending radially from the center mandrel (c) a plurality of cutting heads, wherein each of the cutting heads:

(i) is supported by at least one of the radial members (ii) is arcuately spaced apart around the center mandrel from the other cutting heads;

(iii) has a rounded surface, wherein a portion of the rounded surface faces radially outward to present a curved profile when viewed from a direction along the mandrel axis, and wherein the curved profile of the rounded surface of each cutting head is of an arc of a circle having a radius from the mandrel axis; and (d) a plurality of cutting teeth on the rounded surface of each of the cutting heads, wherein each of the plurality of cutting teeth on the rounded surface of each of the cutting heads has at least one cutting edge, wherein at least a portion of a length of the cutting edge is oriented facing a direction of rotation around the mandrel axis, whereby, when the reamer is rotated about the mandrel axis, the cutting edge of each of the plurality of cutting teeth is presented toward the rotational direction.

12. The reamer according to claim 6, further comprising a plurality of wear bars on the rounded surface of each of the cutting heads.

13. The reamer according to claim 1, further comprising a plurality of mud ports.

14. An assembly for use in horizontal drilling under a surface barrier for installing an underground conduit, the assembly comprising:

(a) a horizontal drilling rig;

(b) a drill pipe having one end thereof connected to the drilling rig, whereby the drilling rig can rotate and advance the drill pipe;

(c) a reamer operatively connected to the drill pipe, whereby the reamer can be rotated and advanced with the drill pipe, the reamer comprising:

(i) a center mandrel, wherein the center mandrel defines a mandrel axis;

(ii) a plurality of radial members extending radially from the center mandrel;

(iii) a plurality of cutting heads, wherein each of the cutting heads:

(a) is supported by at least one of the radial members;

(b) is arcuately spaced apart around the center mandrel from the other cutting heads;

(c) has a rounded surface, wherein the rounded surface is of an arcuate section of a torus;

and (iv) a plurality of cutting teeth on the rounded surface of each of the cutting heads.

15. A method of horizontal boring is provided for installing an underground conduit, the method comprising the steps of:

(a) opening a pit or trench on each side of a barrier or surface area to be traversed underground;

(b) forming a pilot bore between the two trenches;

(c) reaming the pilot bore to form an enlarged bore with a reamer, wherein to reamer comprises:

(i) a center mandrel, wherein to center mandrel defines a mandrel axis;

(ii) a plurality of radial members extending radially from the center mandrel;

(iii) a plurality of cutting heads, wherein each of the cutting heads:

(a) is supported by at least one of the radial members;

(b) is arcuately spaced apart around the center mandrel from the other cutting heads;

(c) has a rounded surface, wherein the rounded surface is of an arcuate section of a torus;

and (iv) a plurality of cutting teeth on the rounded surface of each of the cutting heads.

16. A reamer for underground boring, the reamer comprising:

(a) a center mandrel, wherein the center mandrel defines a mandrel axis;

(b) a plurality of radial members extending radially from the center mandrel;

(c) a plurality of cutting heads, wherein each of the cutting heads:

(i) is supported by at least one of the radial members;

(ii) is arcuately spaced apart around the center mandrel from the other cutting heads;

(iii) has a rounded surface; and (d) a plurality of cutting teeth on the rounded surface of each of the cutting heads, wherein each of the plurality of cutting teeth on the rounded surface of each of the cutting heads has at least one cutting edge, wherein at least a portion of a length of the cutting edge is oriented facing a direction of rotation around the mandrel axis, whereby, when the reamer is rotated about the mandrel axis, the cutting edge of each of the plurality of cutting teeth is presented toward the rotational direction.

17. A method of horizontal boring is provided for installing an underground conduit, the method comprising the steps of:

(a) opening a pit or trench on each side of a barrier or surface area to be traversed underground;

(b) forming a pilot bore between the two trenches;

(c) reaming the pilot bore to form an enlarged bore with a reamer, wherein the reamer comprises:

(i) a center mandrel, wherein the center mandrel defines a mandrel axis;

(ii) a plurality of radial members extending radially from the center mandrel;

(iii) a plurality of cutting heads, wherein each of the cutting heads:

(a) is supported by at least one of the radial members;

(b) is arcuately spaced apart around the center mandrel from the other cutting heads;

(c) has a rounded surface;

and (iv) a plurality of cutting teeth on the rounded surface of each of the cutting heads, wherein each of the plurality of cutting teeth on the rounded surface of each of the cutting heads has at least one cutting edge, wherein at least a portion of a length of the cutting edge is oriented facing a direction of rotation around the mandrel axis, whereby, when the reamer is rotated about the mandrel axis, the cutting edge of each of the plurality of cutting teeth is presented toward the rotational direction.

* * * * *